US005694705A

United States Patent [19]

Alonso Coves

[11] Patent Number: 5,694,705

[45] Date of Patent: Dec. 9, 1997

[54] THERAPEUTIC INSOLE FOR FOOTWEAR

[76] Inventor: Andres Alonso Coves, Ctra. Murcia-Alicante, KM.53, Elche (Alicante), Spain, 03205

[21] Appl. No.: 506,616

[22] Filed: Jul. 24, 1995

Related U.S. Application Data

[63] Continuation of Ser. No. 103,286, Aug. 6, 1993, abandoned.

[30] Foreign Application Priority Data

Aug. 14, 1992 [ES] Spain ..... 9202563

[51] Int. Cl.[6] ..... A43B 13/38; A43B 23/00; A61F 5/14

[52] U.S. Cl. ..... 36/44; 36/141

[58] Field of Search ..... 36/43, 44, 141, 36/145, 147, 140, 31, 32 R, 30 R, 25 R, 11.5, 3 B, 59 C

[56] References Cited

U.S. PATENT DOCUMENTS

| | | | |
|---|---|---|---|
| D. 294,076 | 2/1988 | Birnittella | 36/11.5 X |
| 2,838,776 | 6/1958 | Tax | 36/44 |
| 3,059,350 | 10/1962 | Price | 36/11.5 |
| 3,412,487 | 11/1968 | Diamant | 36/44 |
| 3,595,244 | 7/1971 | Kugler | 36/141 |
| 4,047,310 | 9/1977 | Sundo | 36/11.5 |
| 4,509,510 | 4/1985 | Hook | 36/44 X |
| 4,603,493 | 8/1986 | Eston | 36/44 |
| 4,674,203 | 6/1987 | Goller | 36/141 |
| 4,694,831 | 9/1987 | Seltzer | 36/141 |
| 4,760,655 | 8/1988 | Mauch | 36/141 |
| 4,823,799 | 4/1989 | Robbins | 36/44 X |
| 4,910,882 | 3/1990 | Goller | 36/141 |
| 5,322,056 | 6/1994 | Menghi et al. | 36/11.5 X |

FOREIGN PATENT DOCUMENTS

| | | | |
|---|---|---|---|
| 2052070 | 1/1993 | Canada | 36/141 |
| 2089325 | 9/1993 | Canada | 36/141 |
| 0091808 | 12/1961 | Germany | 36/141 |
| 3503960 | 8/1986 | Germany | 36/44 |
| 208305 | 12/1974 | Spain . | |
| 274981 | 10/1980 | Spain . | |
| P-8900063 | 1/1989 | Spain . | |

OTHER PUBLICATIONS

Plantillas CAS–TOR S.L. Leaflet.

*Primary Examiner*—B. Dayoan
*Attorney, Agent, or Firm*—Darby & Darby

[57] ABSTRACT

An insole is formed by the combination of two laminar bodies, one of split leather and another one of rubber material or the like, the latter provided with knobs forming support projections for the foot. The rubber body remains located under a window of the split leather body, the latter defining a wide perimetric raised strip with a transversal band in the area of the toe piece and an area set in the inside part of the shank. Both bodies can be connected by means of a seam or by means of gluing, to form a single body that will be superposed and fastened by any conventional system to a bottom support body to form a sole apt for receiving the assembly of the corresponding section of footwear. The split leather body provides the possibility of transpiration and knobs of the rubber body which provide therapeutic effects on the user's feet.

7 Claims, 1 Drawing Sheet

THERAPEUTIC INSOLE FOR FOOTWEAR

This is a continuation of application Ser. No. 08/103,286, filed Aug. 6,1993 now abandoned.

As is expressed in the title of this specification, the present invention refers to an improved insole for footwear, based on a structure defined by the Association of a split leather body or sheet joined by sewing or gluing to a rubber sheet provided with its own projections to activate circulation.

BACKGROUND OF THE INVENTION

Numerous types of insoles are known, in some cases made out of elastic material with knobs that enhance circulation in the user's feet and produce therapeutic effects when the insole in question is applied to specific footwear.

In other cases there are insoles with combined layers of cushioned material and elastic material or rubber, in other cases the insoles are made to allow good transpiration.

Hence, the sole claimed in utility model 208.305, in which a middle area with cylindric knobs and end areas corresponding to the heel and the toe piece are defined with other knobs located between interwoven partitions, all in order to provide suction effects that make adherence quality effective in each point, can be cited.

Likewise, utility model 274.981 in which a sole formed by a bottom layer and another cushioned top layer, both being provided on their opposite surfaces suitable and complementary recesses and projections to define areas harder than others, which will logically be softer, in order to try to provide comfort to the user, can be cited.

Likewise, Spanish number P-8900063, in which a sole for footwear comprised of a slab cork core around which a rubber rim has been vulcanized and upon which a fluff split leather covering exists maintaining superficially the anatomical shape of the foot, and including underneath a conventional sole or sole with suitable resistance to take contact with the ground, all in order to try to achieve good transpiration and comfort for the user, can be cited.

DESCRIPTION OF THE INVENTION

The insole object of the invention has the particularity that its structure is defined by the combination of two bodies, complemented by a bottom support body of the two previous ones.

The two basic bodies are formed, one of them, by an elastic material insole, of rubber or the like, having a series of knobs with a convex surface that provide therapeutic effects for the user, enhancing transpiration and more comfort when walking. The second body is comprised of a split leather sheet fastened by sewing or gluing to the rubber sheet, so that together with the bottom support that the insole will have, the latter has a very high consistency, offering a quality of finish without detriment to the user's comfort.

In this sense, the split leather sheet extends over or covers the perimetric area of the sheet provided with the knobs, as well as a traversal area of the toe piece and a considerably broad area of the inside part of the shank, with the particularity that the perimeter of the split leather sheet defines a wide band that remains raised with regard to the surface that the sheet provided with knobs defines, delimiting this raised part in the contour of the insole, or that is to say defining the anatomical shape of the insole.

Therefore, the insole of the invention has a structure so that in the connection or combination together of the rubber sheet with the knobs and the perimetric split leather sheet, the insole is provided with a very good consistency, with a better quality finish than conventional insoles and also providing transpiration in virtue precisely of that split leather sheet which classic insoles provided with knobs that activate the user's blood circulation do not normally include.

In order to complement the description that is going to be made hereinafter and for the purpose of providing a better understanding of the features of the invention, the present specification is accompanied by a set of drawings on the grounds of which the innovations and advantages of the insole for footwear object of the invention will be more easily understood.

DESCRIPTION OF THE PREFERRED EMBODIMENT

Figure 1:
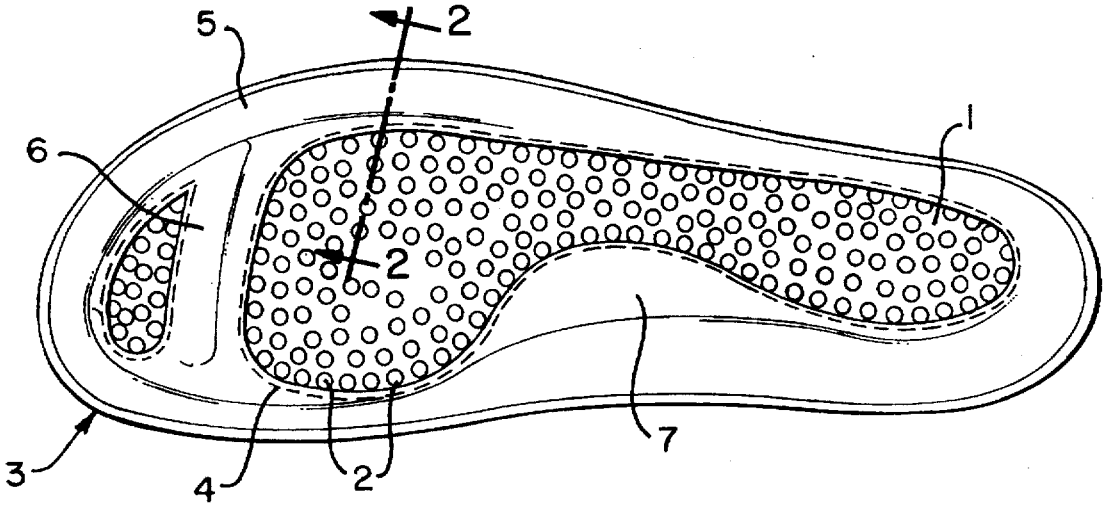
FIG. 1 is a top plan view of the insole where one can clearly see the surfaces provided with knobs and the split leather surface that the insole itself includes.
Figure 2:
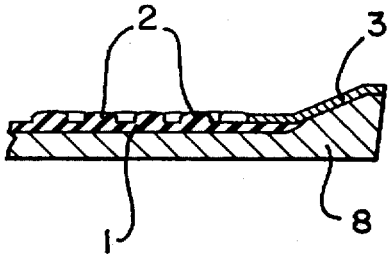
FIG. 2 is a sectional view along line 2—2 of FIG. 1 and looking in the direction of the arrow, the figure showing the insole with its corresponding support, allowing one to see the structure and arrangement of the different parts that form the insole.

In view of the figures commented on, one can see how the insole of the invention is basically comprised of two sheets, one with reference number 1 and made out of an elastic material, such as rubber or the like, and having a plurality of knobs 2 with a curved-convex top part, the other sheet having reference number 3 and being comprised of a split leather body that is fastened to sheet 1 by means of a seam 4 or by means of gluing or any other conventional system.

The split leather sheet or body 3 is applied perimetrically with regard to sheet 1, defining a wide perimetric strip 5 with a transversal section or band 6 in correspondence with the toe piece and a broad area 7 that sets in correspondence with the inside part or surface of the shank. These two sheets 1 and 3 fastened as it has been said above, are superposed and adhered to a bottom body 8, acting as a support, to define a sole on which it is only necessary to assembly the rest of the corresponding footwear section.

Sheets 1 and 3 connected in the described manner form an insole with a high consistency, which on the one hand, permits transpiration, in virtue of the split leather material which the sheet 3 is made out of, and on the other hand, upon being provided with knobs 2, circulation is activated or therapeutic effects on the user's feet are produced, so that these two characteristics are not provided to conventional insoles made out of an elastic material with knobs, since the latter do not permit transpiration and besides they lack the rigidness and consistency that the described insole provides.

What is claimed:

1. An insole for use in footwear comprising:

a first sheet having an upper surface and a lower surface, said first sheet being made of one single body, said first sheet being made of an elastic material, said first sheet having a plurality of upwardly projecting knobs having an upper surface disposed at a first predetermined height;

a second sheet joined to said upper surface of said first sheet such that at least a major part of said knobs are uncovered, said second sheet defining a broad perimetric strip, a transversal band and an area at an inside edge of a sole shank, said transversal band corresponding to a toe area of said insole;

a support body joined to a bottom portion of said first sheet, said support body having an upper surface and a bottom surface, said upper surface having a central zone and a perimetric zone, said perimetric zone being raised with respect to said central zone, said perimetric zone being covered by said second sheet such that said second sheet defines a broad perimetric strip disposed at a second predetermined height, said second height being greater than said first height.

2. An insole according to claim 1, wherein all of said knobs are uncovered.

3. An insole in accordance with claim 1, wherein said elastic material is rubber.

4. An insole in accordance with claim 3, wherein said second sheet is attached to said first sheet by sewing.

5. An insole in accordance with claim 3, wherein said second sheet is attached to said first sheet by bonding.

6. An insole in accordance with claim 1, wherein said second sheet is attached to said first sheet by sewing.

7. An insole in accordance with claim 1, wherein said second sheet is attached to said first sheet by bonding.

* * * * *